US008852731B2

(12) United States Patent
Baldwin et al.

(10) Patent No.: US 8,852,731 B2
(45) Date of Patent: Oct. 7, 2014

(54) PYROPHORIC SHEET

(75) Inventors: Richard K. Baldwin, San Diego, CA (US); Steven J. Oldenburg, San Diego, CA (US); Andrew R. Smith, San Diego, CA (US)

(73) Assignee: nanoComposix, Inc., San Diego, CA (US)

( * ) Notice: Subject to any disclaimer, the term of this patent is extended or adjusted under 35 U.S.C. 154(b) by 0 days.

(21) Appl. No.: 14/233,871

(22) PCT Filed: Jul. 19, 2012

(86) PCT No.: PCT/US2012/047327
§ 371 (c)(1), (2), (4) Date: Jan. 20, 2014

(87) PCT Pub. No.: WO2013/016116
PCT Pub. Date: Jan. 31, 2013

(65) Prior Publication Data

US 2014/0162003 A1 Jun. 12, 2014

Related U.S. Application Data

(60) Provisional application No. 61/572,845, filed on Jul. 22, 2011.

(51) Int. Cl.

| | |
|---|---|
| ***A01K 1/015*** | (2006.01) |
| ***D21H 27/00*** | (2006.01) |
| ***D21H 15/02*** | (2006.01) |
| ***D21H 13/36*** | (2006.01) |
| ***D21H 13/40*** | (2006.01) |
| ***C06C 15/00*** | (2006.01) |
| ***C06B 45/14*** | (2006.01) |
| ***D21H 17/66*** | (2006.01) |
| ***D21H 15/00*** | (2006.01) |
| ***D21H 17/63*** | (2006.01) |
| ***F41J 2/02*** | (2006.01) |
| *D21H 19/10* | (2006.01) |

(52) U.S. Cl.
CPC . *F41J 2/02* (2013.01); *D21H 19/10* (2013.01); *D21H 27/00* (2013.01); *D21H 15/02* (2013.01); *D21H 13/36* (2013.01); *D21H 13/40* (2013.01); *C06C 15/00* (2013.01); *C06B 45/14* (2013.01); *D21H 17/66* (2013.01); *D21H 15/00* (2013.01); *D21H 17/63* (2013.01)
USPC ..... 428/221; 162/218

(58) Field of Classification Search
USPC ..... 428/221, 35.2; 162/218
See application file for complete search history.

(56) References Cited

U.S. PATENT DOCUMENTS

| | | | |
|---|---|---|---|
| 3,311,459 | A | 3/1967 | Francis et al. |
| 4,435,481 | A | 3/1984 | Baldi |

(Continued)

FOREIGN PATENT DOCUMENTS

| | | | |
|---|---|---|---|
| GB | 2 224 729 | A | 5/1990 |
| RU | 2 120 930 | C1 | 10/1998 |

(Continued)

OTHER PUBLICATIONS

International Search Report and Written Opinion mailed Nov. 29, 2012 in PCT Application No. PCT/US2012/047327, filed Jul. 19, 2012.

(Continued)

*Primary Examiner* — N. Edwards
(74) *Attorney, Agent, or Firm* — Knobbe Martens Olson & Bear LLP

(57) ABSTRACT

A pyrophoric sheet that comprises oxidizable iron, non-combustible fibers, stiction-reducing coating where the sheet has a water content <2%.

10 Claims, 6 Drawing Sheets

(56) References Cited

U.S. PATENT DOCUMENTS

| | | | |
|---|---|---|---|
| 4,708,913 | A | 11/1987 | Baldi |
| 4,756,299 | A | 7/1988 | Podella |
| 4,824,482 | A | 4/1989 | Baldi |
| 4,880,483 | A | 11/1989 | Baldi |
| 4,895,609 | A | 1/1990 | Baldi |
| 5,182,078 | A | 1/1993 | Baldi |
| 5,425,975 | A | 6/1995 | Koiso et al. |
| 5,464,699 | A | 11/1995 | Baldi |
| 6,127,294 | A | 10/2000 | Koiso et al. |
| 7,338,516 | B2 | 3/2008 | Quincy et al. |
| 7,625,464 | B2 | 12/2009 | Matsui et al. |
| 7,749,357 | B2 | 7/2010 | Kumamoto et al. |
| 2006/0151136 | A1 | 7/2006 | Kumamoto et al. |
| 2008/0292879 | A1 | 11/2008 | Kumamoto et al. |
| 2009/0050245 | A1 | 2/2009 | Lay |

FOREIGN PATENT DOCUMENTS

| | | | |
|---|---|---|---|
| SU | 1730089 | A1 | 4/1992 |
| WO | WO 94/24074 | | 10/1994 |

OTHER PUBLICATIONS

Cartes, V., et al., "Study of thermal decomposition of $FeC_2O_42H_2O$ under hydrogen," Thermochimica Acta 334 (1999) 107-113, 1999.

Shende, R., et al. "Pyrophoric Nanoparticles and Nanoporous Foils for Defense Applications," Proceedings of the Army Science Conference (26th) held in Orlando, Florida on Dec. 1-4, 2008.

International Preliminary Report on Patentability issued on Jan. 28, 2014 in PCT Application No. PCT/US2012/047327, filed Jul. 19, 2012.

Examination Report dated Mar. 14, 2014 in GB Application No. 1402927.6, filed Feb. 19, 2014.

PYROPHORIC SHEET

CROSS-REFERENCE TO RELATED APPLICATIONS

This application claims the benefit and priority to U.S. Provisional Application Ser. No. 61/572,845, filed on Jul. 22, 2011, which is incorporated by reference herein in its entirety for all purposes.

STATEMENT REGARDING FEDERALLY SPONSORED R&D

This invention was made with government support under N68335-10-C-0496 and N68335-12-C-0096 awarded by the United States Navy. The government has certain rights in the invention.

BACKGROUND OF THE INVENTION

1. Field of the Invention

The present invention relates to a pyrophoric sheet, processes for its manufacture, and its use as an infrared decoy device. The pyrophoric sheet can utilize the heat generation accompanying the oxidation of iron with oxygen in air. The present invention also relates to such a pyrophoric sheet that contains an additive that reduces the stiction between adjacent sheets when the sheets are packed into a container and subsequently ejected from the container, and a method of producing the same, and its use as an infrared decoy device.

2. Description of the Related Art

Heat generating devices can be ejected from vehicles and aircraft to divert heat-seeking missiles away from a target and/or to disrupt heat-seeking missiles from locking onto a target. These infrared-generating devices contain a payload that heats to a predetermined temperature when the device is functioned. One type of infrared-generating device utilizes pyrotechnic payloads to produce high temperatures (>1000° C.). Another type of payload employs pyrophoric materials that ignite spontaneously when exposed to atmospheric oxygen. Pyrophoric materials can be designed to function at lower temperatures than pyrotechnic materials, which reduces the visible signature from the device and increases the operational covertness.

To maximize the effectiveness of a pyrophoric infrared decoy it is desirable to generate a heat emitting cloud that has a large infrared emitting cross section. One method of increasing the cross section is to process the pyrophoric materials into thin sheets (coupons) that are stacked into a container. Upon ejection, the coupons separate and heat, forming an infrared emitting cloud with a large cross section.

U.S. Patent Application No. 20090050245 discloses a process for producing a pyrophoric material in which metal carboxy compounds are coated onto a combustible substrate such as cloth. The coated substrate is heated in an oxygen free atmosphere to render the substrate pyrophoric. The method of fabricating a pyrophoric material where the pyrophoric precursor is applied to an existing substrate has limitations associated with the types of substrates that can be utilized as a support matrix, the loading levels and distribution of the particles within the substrate, and the production throughput.

U.S. Pat. No. 7,749,357 discloses a papermaking process to fabricate a heat generating molded sheet that contains an oxidizable metal, a moisture retaining agent, and a fibrous material. The molded sheets are described as utilizing an iron powder that has dimensions of microns and, in the presence of an electrolyte solution, heats over a period of minutes. This technique does not produce a heated sheet with a sufficiently high temperature to perform as an infrared decoy.

Accordingly, an object of the present invention is to provide a heat generating sheet that when ejected from a device provides a large infrared cross section that will be effective as a decoy from a heat seeking missile and a method of producing the infrared heating elements.

SUMMARY OF THE INVENTION

An embodiment provides a pyrophoric sheet comprising oxidizable iron, non-combustible fibers, and a stiction-reducing additive, wherein the sheet has a water content of about 2% or less, by weight based on the total weight of the sheet, and wherein the oxidizable iron and the non-combustible fibers are dispersed within the sheet in an amount that is effective to heat the sheet to a temperature greater than 100° C. in less than 2 seconds upon exposure of the sheet to air.

Another embodiment provides a stack of sheets as described herein.

Another embodiment provides a method of producing a pyrophoric sheet, comprising: forming a wet web by a papermaking process using a raw material composition that comprises particles, wherein the particles comprise a reducible iron complex and a non-combustible fibrous material; dewatering the wet web to form a dewatered wet web; drying the dewatered wet web to form a precursor sheet; and heating the precursor sheet to a temperature greater than 100° C. in an anaerobic atmosphere to form the pyrophoric sheet; wherein said pyrophoric sheet has a thickness of less than about 0.5 mm and an oxidizable iron content of at least about 20%, by weight based on total weight of the sheet.

Another embodiment provides a method for forming an infrared decoy device, comprising: forming a wet web by a papermaking process using a raw material composition that comprises particles, wherein the particles comprise a reducible iron complex and a non-combustible fibrous material; dewatering the wet web to form a dewatered wet web; drying the dewatered wet web to form a sheet; coating the sheet with a stiction-reducing additive to produce a coated sheet; cutting the coated sheet to produce coupons; stacking the coupons in a container; heating the container to a temperature greater than 100° C. in an anaerobic atmosphere to form pyrophoric coupons; transferring the pyrophoric coupons to a second container; and sealing the second container to from an air tight infrared decoy device These and other embodiments are described in greater detail below.

DETAILED DESCRIPTION OF THE PREFERRED EMBODIMENTS

Figure 1:
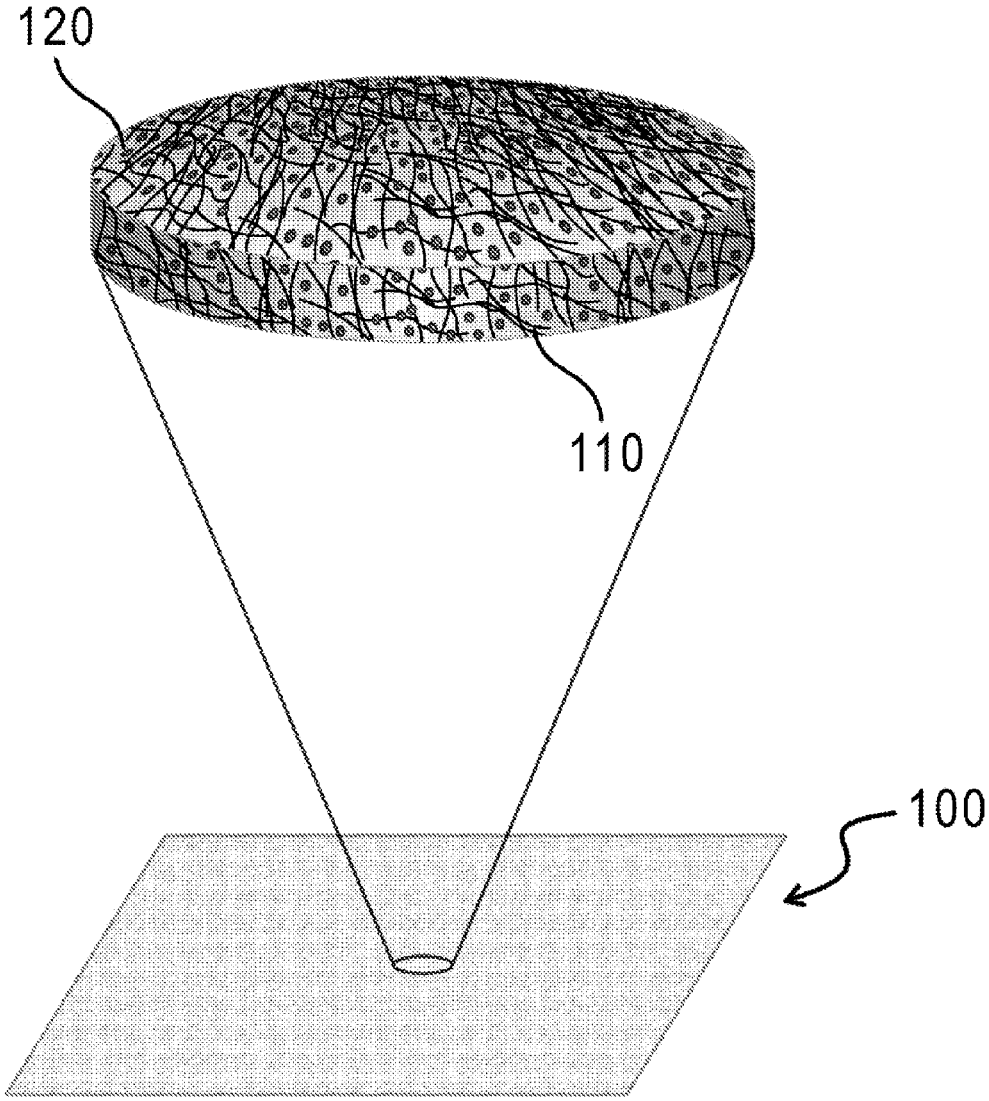
FIG. 1 illustrates a sheet that contains fibers and particles.

Embodiments of this invention include a pyrophoric sheet that when exposed to oxygen rapidly heats. In this context, a "sheet" is defined to be a three dimensional structure that, when measured along its principal axis, has two axial dimensions that are greater than 5 mm and one axial dimension that is less than 2 mm. FIG. 1 illustrates a sheet 100 that contains fibers 110 and iron particles 120 dispersed throughout the sheet 100. Examples of sheets include various types of paper, including printer paper, paper towels, and filter paper. A sheet is "pyrophoric" when the sheet self-ignites in the presence of oxygen. For example, a pyrophoric sheet self-ignites in the presence of air. In contrast to pyrotechnic materials, no fuse or other flammable ignition source is required for the generation of heat from a pyrophoric material.

Figure 2A:
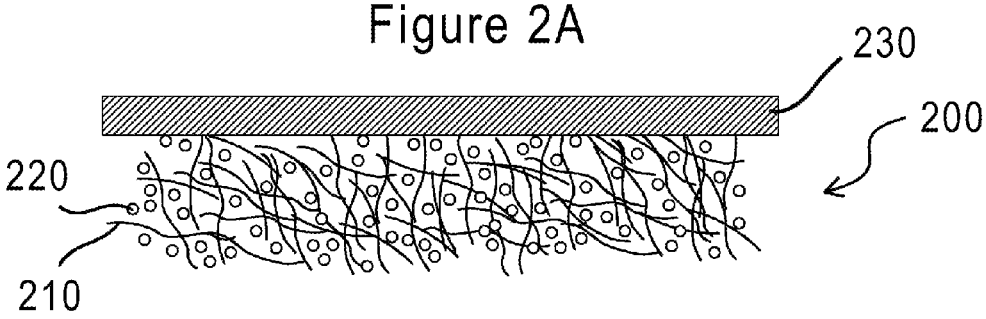
FIG. 2A illustrates a sheet that contains fibers and oxidizable iron particles with a stiction-reducing coating on one side of the sheet.
Figure 2B:
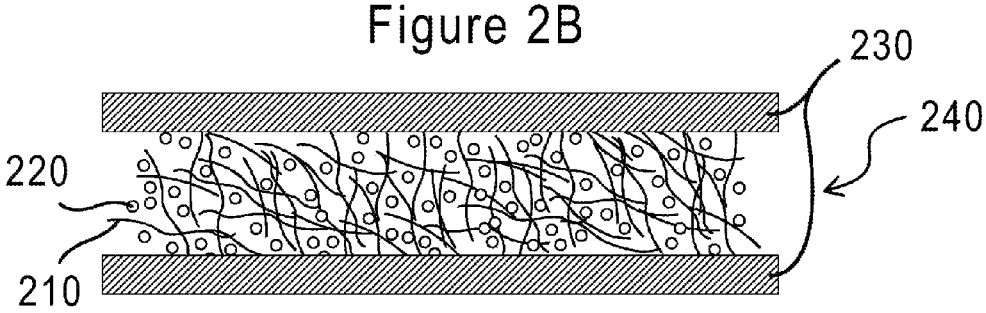
FIG. 2B schematically illustrates a sheet that has a stiction-reducing coating on both sides of the sheet.

In an embodiment, the pyrophoric sheet comprises at least a fiber support, particles that contain oxidizable iron (which may be referred to herein as oxidizable iron particles), and a stiction-reducing additive. The stiction-reducing additive can be applied to the surface of the sheet as a coating and/or can be dispersed within the sheet. FIGS. 2A-B illustrate cross-sectional views of variants of pyrophoric sheets 200 and 240. The pyrophoric sheet 200 includes a fiber support 210, particles 220 that contain oxidizable iron that are dispersed with the fiber support 210 throughout the sheet 200, and a stiction-reducing coating 230 that is applied to one side of the sheet 200. FIG. 2B illustrates an embodiment in which the coating 230 is applied to both sides of the sheet 240.

Figure 3A:
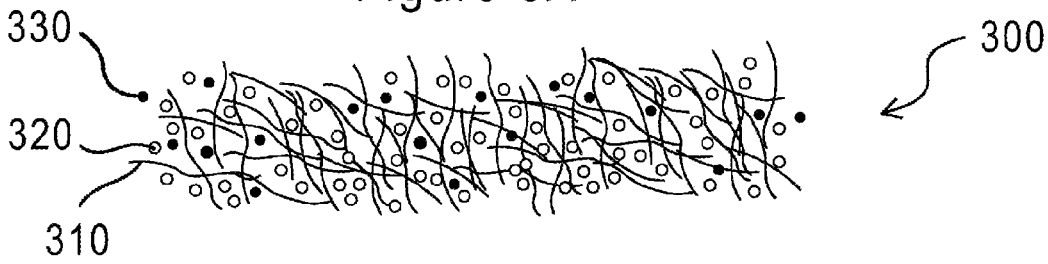
FIG. 3A illustrates a sheet that contains fibers, oxidizable iron particles and a stiction-reducing additive that is distributed throughout the sheet.
Figure 3B:
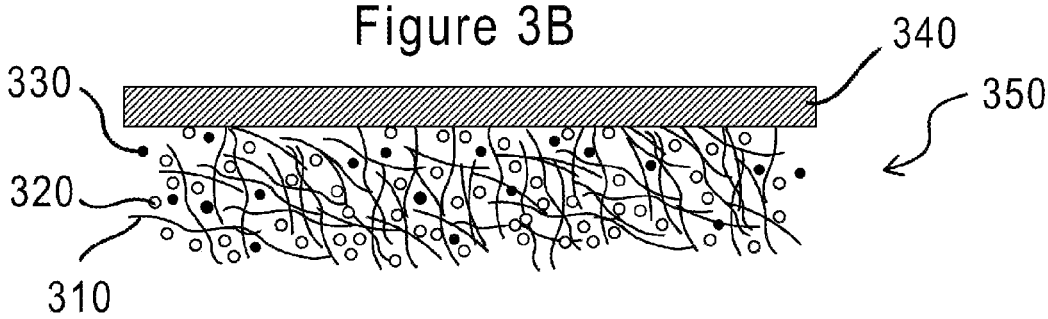
FIG. 3B schematically illustrates the sheet of FIG. 3A that has a stiction-reducing coating on one side of the sheet and FIG. 3C schematically illustrates the sheet of FIG. 3A that has a stiction-reducing coating on both sides of the sheet.
Figure 3C:
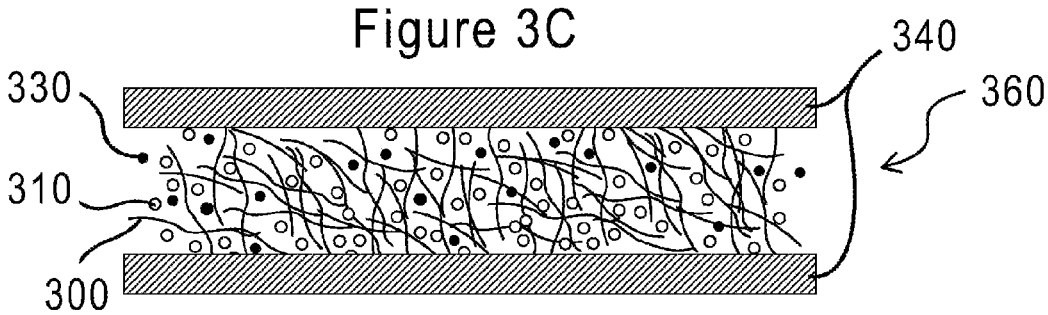

FIG. 3A illustrates an embodiment of a sheet 300 which includes a fiber support 310, particles 320 that contain oxidizable iron and a stiction-reducing additive 330 that is in the form of particles dispersed throughout the sheet 300. FIG. 3B illustrates an embodiment of a pyrophoric sheet 350 that has a stiction-reducing coating 340 on one surface of the sheet 350. FIG. 3C illustrates an embodiment of a pyrophoric sheet 360 that has a stiction-reducing coating 340 on both surfaces of the sheet 360 and in the form of particles 330 dispersed throughout the sheet 360. In another embodiment (not illustrated in FIG. 3) the stiction-reducing additive 330 that is dispersed throughout the sheet partially or fully coats the fiber support 310 and/or the oxidizable iron particles 320.

Figure 4:
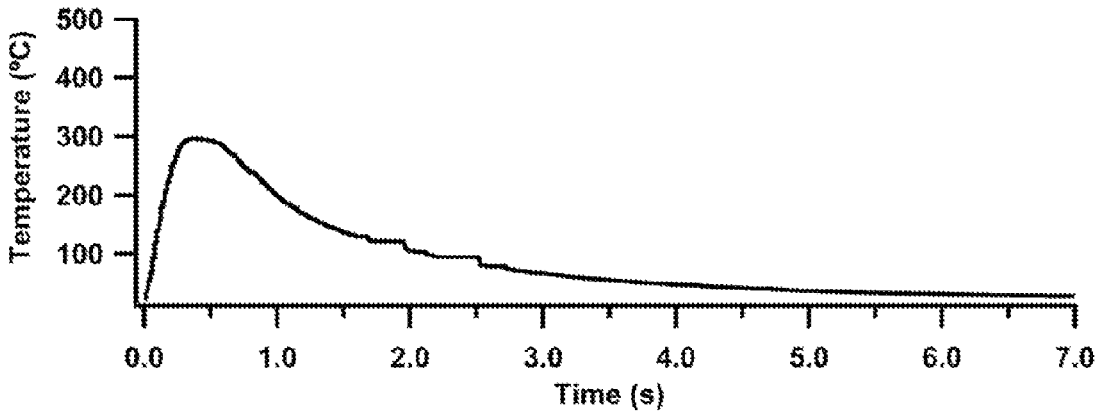
FIG. 4 illustrates a plot of temperature as a function of time for a pyrophoric sheet when exposed to oxygen.

The pyrophoric sheet (e.g., the sheets 100, 200, 240, 300, 350, 360) preferably contains oxidizable iron particles in which the oxidation state of the iron is less than the stable iron oxidation state of $Fe_2O_3$ or $Fe_3O_4$. Examples of such particles 120, 220, 320 are illustrated in FIGS. 1-3. The oxidation state of the oxidizable iron particles is between zero and three, in which case the oxidizable iron particles are pyrophoric and may be referred to herein as pyrophoric iron particles or pyrophoric iron. Preferably the pyrophoric iron has an oxidation state less than 2 and more preferably an oxidation state below 1. In a preferred embodiment, over 20% of the iron in the sheet is in an oxidation state less than 2 and in a more preferred embodiment over 50% of the iron in the sheet will be in an oxidation state less than 2. When the pyrophoric sheet is exposed to oxygen, the oxidation state of the pyrophoric iron particles increases rapidly and produces rapid heating of the iron particles and sheet. In an embodiment, a substantial portion of the oxidizable iron, such as >20%, >50%, or >80%, is oxidized when the sheet (e.g., the sheets 100, 200, 240, 300, 350, 360) is exposed to air. The oxidizable iron particles (e.g., the particles 120, 220, 320) are sufficiently small that they collectively have a high surface area and thus react rapidly with the oxygen in air to generate significant heat without the need for other accelerants, moisture and/or electrolytes. The temperature to which the pyrophoric sheet will heat when exposed to oxygen depends on a number of factors including the size and oxidation state of the oxidizable iron particles, the concentration of oxidizable iron within the pyrophoric sheet, the coating(s) on the sheet (if any), the density of the sheet, the concentration of the oxygen in the gas (e.g., air) to which the sheet is exposed, and the direction and speed of the oxygen flow on the sheet. Sheet heating temperatures can be measured using a temperature measurement device such as an infrared (IR) camera or a thermopile. Peak temperature of the sheet can be greater than 100° C., 200° C., 300° C., or 500° C. A plot of the temperature vs. time (in seconds) for an embodiment of a pyrophoric sheet when exposed to air is shown in FIG. 4.

In an embodiment, the oxidizable iron particles in the pyrophoric sheet have a mean particle size (d50) of less than 2 microns. For example, the oxidizable iron particles can have a mean particle size less than 0.8 micron or less than 0.3 micron. Mean particle size is defined to be the measurement of the diameter of the generally spherical particles that are discernible with a scanning electron or transmission electron microscope. If two generally spherical particles are sintered together or agglomerated, mean particle size refers to the diameter of the individual generally spherical particles that have been associated or are sintered together. Another method of determining particle size is to utilize an instrument that measures the surface area of the particles such as the Micromeritics Gemini BET surface area analyzer. Generally spherical iron particles having a mean diameter of 10 microns have a BET surface area of approximately 0.08 $m^2/g$. Generally spherical iron particles with a diameter of 0.8 microns have a BET surface area of approximately 1.0 $m^2/g$. Preferably the pyrophoric iron particles that are dispersed with the fibers or embedded within the pyrophoric sheet have a surface area that is greater than 1.0 $m^2/g$. Oxidizable iron particles can be nanoparticles, e.g., particles having a mean particle size (d50) of about 300 nm or less, or about 100 nm or less.

In an embodiment, the fibers in the pyrophoric sheet are non-combustible and thus not capable of igniting and burning when the pyrophoric sheet is exposed to oxygen. Examples of non-combustible fibers that can be incorporated into the pyrophoric sheet include fibers that contain silica, silicates, alumina, aluminosilicates, ceramics, carbon, and/or other solids made from nitrides, oxides and/or carbides. All types of glass fibers can be used, including fibers that have different elements incorporated into the glass fiber to change the physical and/or chemical properties of the fiber. All types of carbon fibers including carbon nanotubes and carbon nanofibers can also be used. In an embodiment, the non-combustible fibers have a length in the range of 0.02 microns to 10 millimeters and a diameter in the range of 0.02 micron to 20 micron. In an embodiment, the fibers can comprise bundles of smaller diameter fibers. The average aspect ratio (diameter:length) of the fibers is in the range of 1:3 to 1:1000. In an embodiment, the fibers have a mix of different lengths and/or different diameters. The use of fibers with different diameters will tend to impart different structural properties to the sheet. In an embodiment, a mixture of fibers are incorporated into the pyrophoric sheet; for example, a mixture of fibers with diameters greater than 10 microns with fibers that have diameters less than 3 microns.

In a preferred embodiment the pyrophoric sheet includes a stiction-reducing additive (e.g., the stiction-reducing coatings 230, 340 and the stiction-reducing additive 330). The stiction-reducing additive reduces adhesion between adjacent sheets and thus reduces the forces required to separate stacked sheets when the sheets are ejected from a canister into the air. Without the stiction-reducing additive, the stacked sheets are more likely to bind together reducing the total number of individual sheets that are constituents of the heat emitting cloud. In an embodiment the stiction-reducing additive is a coating primarily on one or both surfaces of the sheet. In another embodiment the stiction-reducing additive is infused throughout the sheet. In another embodiment, a stiction-reducing additive is infused throughout the sheet and a stiction-reducing coating is applied to one or both surfaces of the sheet. In an embodiment, the additive can comprise a dry lubricant such as carbon (e.g. graphite), boron nitride, molybdenum disulfide, cerium fluoride, calcium fluorides, rare-earth fluorides, and/or tungsten disulfide. In an embodiment, the additive can comprise metal particles (e.g. brass, copper, indium, lead, silver, tin) that are spherical, rod-like, or flake-like in shape, fluorine containing compounds (e.g. polytetrafluorethylene), solid oxides, silicates, and/or talc. The additive can also be a dry inorganic salt or combination of inorganic salts. Examples of inorganic salts are salts that contain silicate, borate, nitrate, sulfate, and/or carbonate. In an embodiment, the salt can be a basic salt, a normal salt, a neutral salt, a double salt, a complex salt or an acid salt. In a preferred embodiment, the additive contains sodium borate. In another embodiment the additive can be a material that does not burn or melt at temperatures between 200° C. and 500° C. Combinations of any of the above-mentioned stiction-reducing additives can be applied to one or both of the surfaces of the sheet, infused within the sheet, or both infused and coated onto the surface of the sheet. In an embodiment where the additive is applied to the surface of the sheet, the average thickness of the coating can range from 0.01 microns to 500 microns. In an embodiment where the additive is infused within the sheet, the additive can form particulates that are isolated from the other components of the sheet (e.g. the fibers or the iron particles) and/or can partially or fully coat the other components of the sheet. In an embodiment, the additive modifies the physical properties of the sheet such as the stiffness, the elasticity, the density, the average pore size, the basis weight, the stiction, the dimensional stability, the bursting strength, the compressibility, the hardness, the stretch, the surface strength, the tearing resistance and/or the tensile strength of the sheet.

Figure 5:
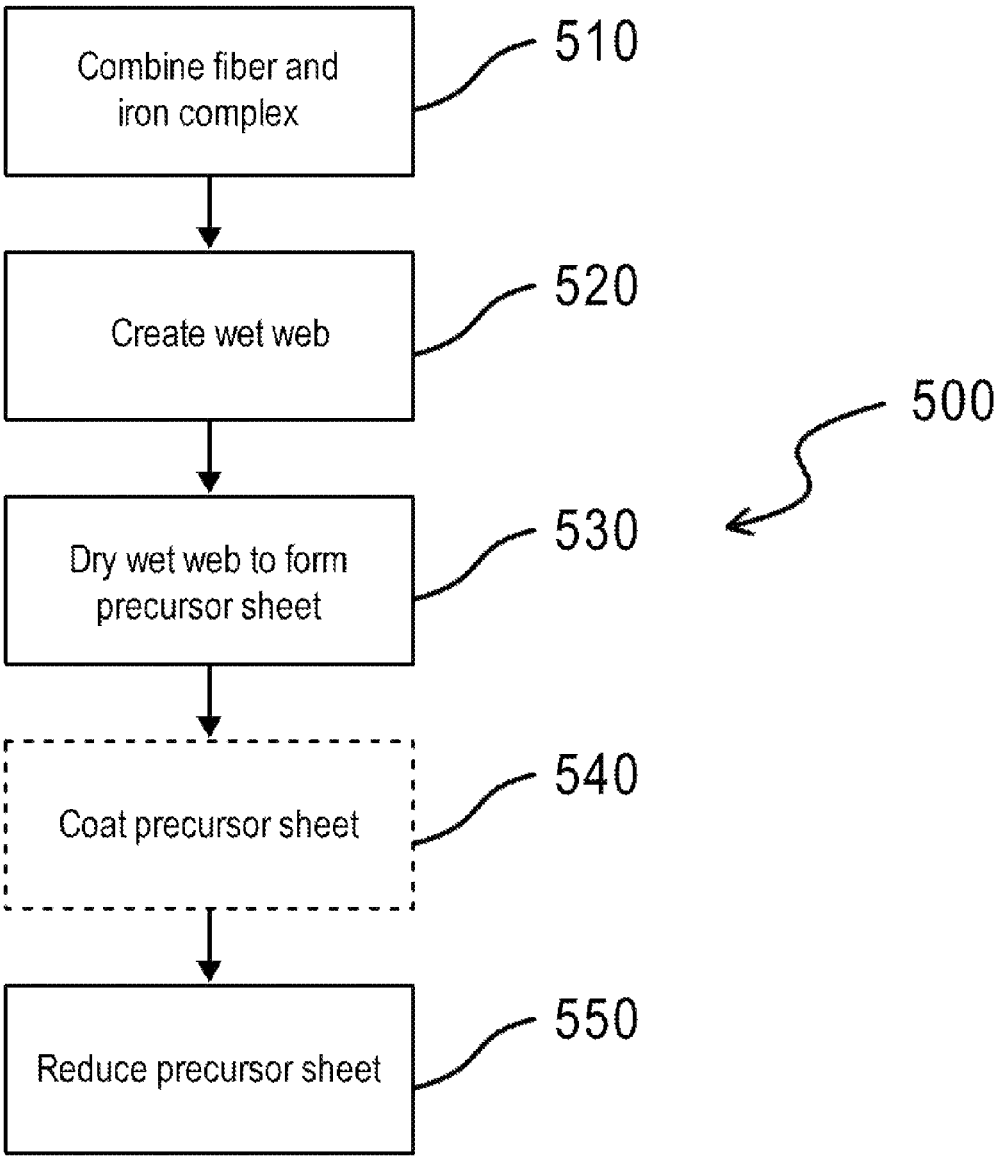
FIG. 5 illustrates a process for fabricating a pyrophoric sheet.

Pyrophoric sheets can be made in various ways, e.g., by techniques similar to those used to make paper as illustrated in FIG. 5. Various embodiments provide a process 500 of producing a pyrophoric sheet that comprises mixing together iron complex precursor particles (which may be referred to herein as a reducible iron complex particles) and a non-combustible fiber at step 510, forming a wet web at step 520, drying the wet web to form a precursor sheet at step 530, optionally applying a coating to the precursor sheet at step 540, and at step 550 reducing the iron complex precursor particles embedded within the precursor sheet in the substantial absence of gaseous oxygen to produce a pyrophoric sheet that heats and emits infrared radiation upon contact with air. Reducing the iron complex precursor particles embedded within the precursor sheet converts them into oxidizable iron particles that render the resulting sheet pyrophoric.

In the illustrated embodiment, the first step 510 in the production of a pyrophoric sheet is to combine fibers with iron complex precursor particles in which the oxidation state of the iron complex precursor particles is generally at least 2. Such iron complex precursor particles may be referred to herein as reducible iron complex particles. At this stage, prior to reduction of the reducible iron complex particles (e.g., by exposure to a reducing atmosphere), the precursor sheet into which they are incorporated is not pyrophoric. An embodiment provides such a precursor sheet that comprises a reducible iron complex, non-combustible fibers, and, optionally, a stiction-reducing additive. Additionally, other components such as binders, metal particles, combustible fibers, and accelerants can be incorporated into the precursor sheet (and into the resulting pyrophoric sheet). In an embodiment, the precursor sheet is wet and contains water or other solvents. In a preferred embodiment, the water content of the resulting pyrophoric sheet is below 2%, and more preferably below 0.5%. The water content is defined to be the % difference in weight of the sheet before and after being placed in an oven at 105° C. (221° F.), based on the weight of the sheet before. The weight percent of iron in the resulting pyrophoric sheet is preferably above 10%, or above 20%, and more preferably above 30%.

In the illustrated embodiment, precursor sheets containing reducible iron complex particles are formed in steps 520, 530. When heated in an oxygen free atmosphere in step 550, preferably in the presence of a reducing agent such as gaseous hydrogen, the reducible iron complex particles in the precursor sheets are reduced and become pyrophoric, thereby rendering the sheet pyrophoric. The reducible iron complex particles may be generated through a chemical reaction of iron salts such as iron chlorides or sulphates with organic ligands such as oxalic acid, citric acid, tartaric acid or formic acid or other ligands. Preferably, the reducible iron complex particles or combinations of particles include Fe(II) or Fe(III) complexes or Fe(oxalate) complexes. In a preferred embodiment, the reducible iron complex particles comprise or consist of iron oxalate. The reducible iron complex particles may be processed after initial fabrication to change their size and/or shape. Processing methods include but are not limited to milling, shaking, sieving, grinding, cryo-milling, pressurizing, sonication, microfludizing, homogenizing, and/or high velocity impact treatments generally known to those skilled in the art.

One method of combining the reducible iron complex particles with non-combustible fibers (e.g., in the step 510) is to mix them in a liquid pulp suspension. A preferred liquid suspension is water. Various methods to mix the fibers and the reducible iron complex can be used, including stirring, shaking, homogenization, blending, sonication, and pulping. In some embodiments, binders are added to the mixture of reducible iron complex particles and fibers. Binders include glues, silicates (e.g. sodium silicate), starches, clay, and particles with a flake geometry. In some embodiments, stiction-reducing additives can be added directly to the pulp suspension. In other embodiments, the stiction-reducing coating is applied to the precursor paper in a later step, e.g., the step 540 in the illustrated embodiment. In other embodiments, other combustible particulates can be included in the mixture to modify the temperature at which the resulting pyrophoric paper functions. In other embodiments, materials can be added that increase the density of the paper or restrict the access of oxygen to the pyrophoric iron nanoparticles. All of these proposed additives can affect the heating profile and infrared emission properties of the pyrophoric sheet.

In an embodiment, the reducible iron complex particles and support materials are filtered from solution onto a porous support to form a wet web, e.g., at step 520 in the illustrated embodiment. A deckel that comprises a container with a support filter as its base is a preferred support for making the wet web. Examples of a support filter are meshes with pore sizes less than 100 microns, less than 10 microns, or less than 2 microns. In some embodiments the support filter is smooth to generate smooth sheets. In other embodiments, the support filter is rough or otherwise patterned. When sheets are made on top of roughed or patterned support filter, the sheet tends to retain the physical form of the support material and may be referred to as a molded sheet. A molded sheet can have different properties than a flat sheet such as a different compression ratio. After the sheet is formed, it can be dried, e.g., at step 530 in the illustrated embodiment. Methods of drying include the application of a vacuum to the underside of the porous support, blotting the sheet with an absorbent material, or pressing the sheet between flat plates or rollers. Pressure can be applied to the sheet in a process known to those familiar with paper manufacturing as calendaring. Calendaring steps on the wet web and/or the dried sheet can be used. Other formats and methods of manufacturing paper are also suitable to this process. Each of the aforementioned processing steps can change the porosity of the sheet and may affect its pyrophoric properties.

The wet web can be dried, e.g., at step 530 in the illustrated embodiment, at various temperatures ranging from room temperature to 105° C. or greater to form a precursor sheet. In an embodiment, a coating is applied to one or both surfaces of the sheet, e.g., at optional step 540 in the illustrated embodiment. For the application of dry coatings (e.g., dry lubricants), the coating can be brushed or dusted onto the surface of the sheet. For the application of coatings that contain suspended particles, salts, or other dissolved materials, the coating can be sprayed onto or injected into the sheet. In other embodiments, the sheet can be immersed into the coating material. After applying a coating that involves liquids, the sheet is preferably dried to remove the liquids. In other embodiments, the sheet is formed using roll-to-roll sheet processing where the pulping, wet web formation, drying, and coating are performed in a continuous process to generate a long sheet. Various techniques generally known to those skilled in the art of papermaking for the large scale production of paper can be adapted in view of the teachings provided herein for use in the methods for making pyrophoric sheets described herein.

In some embodiments the pyrophoric sheets may be cut, pressed, or stamped into various shapes or sizes for use in the end application. In an embodiment, the resulting cut coupons can be stacked into a container for the reduction step, e.g., the step 550 in the illustrated embodiment. This container can be a container that will be used as the final device housing or can be a container which will be used to reduce the material followed by a transfer to another container that will be used as the final device housing (e.g., infrared decoy device).

Figure 6:
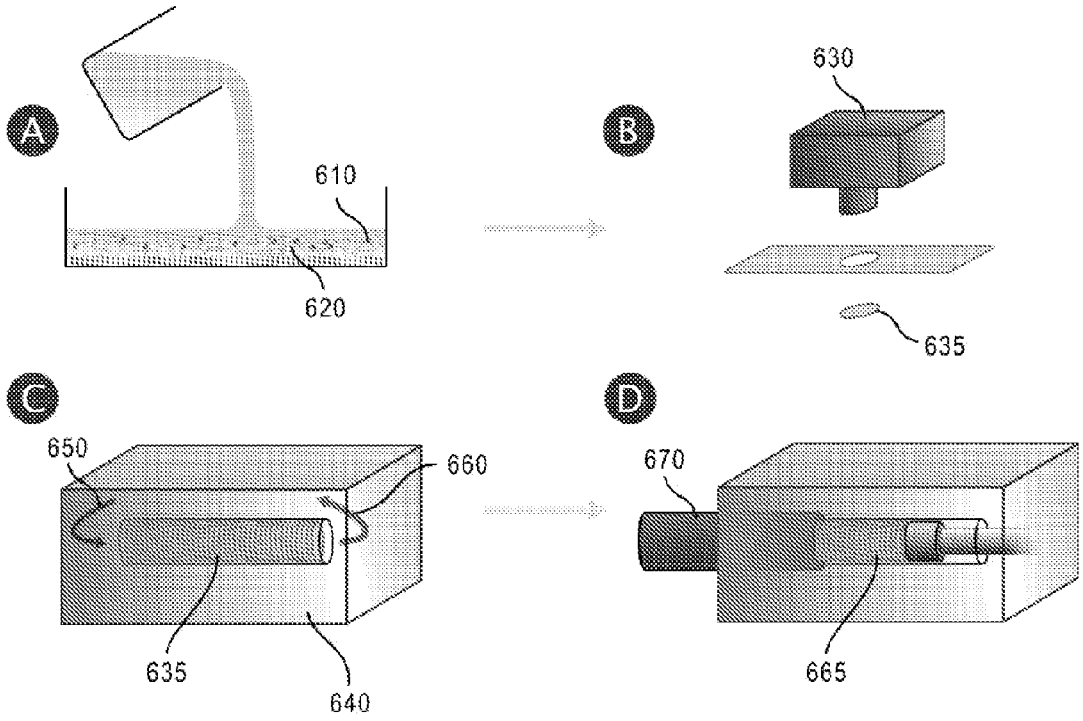
FIG. 6 illustrates steps for fabricating a pyrophoric sheet.

A step in a process for the manufacture of pyrophoric paper is the reduction of the reducible iron complex particles to pyrophoric particles, e.g., the step 550 in the illustrated embodiment. In an embodiment, the process uses heat and any gas or combination of gases that can reduce the iron complex precursor particles which includes but is not limited to hydrogen, nitrogen, argon, syngas, the vapor of another metal, or a mixture thereof. A preferred gas is hydrogen at a concentration of at least 1%, 5%, 10%, 50% or 95% by weight based on total weight of the anaerobic atmosphere. In one embodiment hydrogen gas is mixed with other inert gases. A preferred method of applying heat to the paper is to insert the sheets or coupons thereof into a furnace. The internal temperature of the furnace and the temperature of the reducing gas flow that enters the furnace can be controlled to allow the reducible iron complex particles to be reduced to iron with an oxidation state generally less than 2. Preferably, reduction occurs at a temperature in the range of 100° C. to 600° C. which allows reduction to occur while minimizing sintering, or otherwise damaging the particles. More preferably, the reduction occurs in a temperature range between about 300° C. to about 550° C. The reduction container can have an inlet and an outlet that are sealable with valves such that when the valves are closed, the container is air tight. In an embodiment, the container can be heated using heating tape or inserted into an oven, wherein gas flows through the heated tube and reduces the reducible iron complex particles embedded in the coupons to make them pyrophoric. After reduction, the coupons contain oxidizable iron particles and are pyrophoric. Following reduction, the pyrophoric coupons can be transferred from the reduction container into the final device container in an oxygen free atmosphere. The device can then be sealed to prevent exposure to oxygen before functioning. The steps associated with the manufacturing of one embodiment are shown in FIG. 6. FIG. 6A illustrates reducible iron complex particles 610 being mixed with fibers 620. After extracting the water, the formed sheet is cut with a punch 630 (FIG. 6B) to form coupons 635. The coupons 635 are stacked and assembled into a furnace 640 that is substantially free from oxygen. In one embodiment, a reducing gas is flowed into one end of the container 650 and reactant byproducts flow out of the other end of the container 660 (FIG. 6C). After reduction is complete, the resulting pyrophoric coupons 665 are pushed into the final device container 670 (FIG. 6D).

In a preferred embodiment, the precursor sheet is formed by mixing iron oxalate particles and glass fibers. The glass fibers can have a length in the range of 0.2 micron to 10 microns and a diameter in the range of 0.02 micron to 20 microns, and can be suspended in water. The fibers and iron oxalate particles are mixed together and then collected by gravity or vacuum filtration in a precursor sheet having a thickness in the range of 50 microns to 300 microns. The precursor sheet can be dried and cut into coupons with a circular or square cross-section. The coupons can be stacked in a tube that has a cross-sectional shape that is configured to accommodate the shape of the cut coupons. The tube can be placed inside a larger tube that is capped and sealed. The larger tube can be placed inside a furnace that has an internal temperature in the range of 100° C. to 500° C. Gas lines can be attached to either end of the larger tube and a gas mixture that contains at least 5% hydrogen can be flowed through the large tube. The iron oxalate particles are reduced to oxidizable iron, while remaining embedded within the glass fiber matrix. Upon exposure to air, the resulting pyrophoric paper rapidly oxidizes and heats.

The thin sheet nature of the pyrophoric sheet allows oxygen to access the oxidizable iron particles from one or both sides of the sheet, thereby increasing the rate of oxidation of the oxidizable iron particles and the maximum temperature of the sheet upon exposure to oxygen. In an embodiment the sheet has a thickness in the range of 0.01 mm to 2 mm. Preferably the sheet has a thickness less than 0.5 mm. The sheet can be cut into a particular shape (e.g. circular or square) and can be stacked within a container. When stacked into a container, pressure can be applied to a stack of the sheets to compress the sheets into a smaller volume allowing for more sheets to be packed into a fixed length container device. In an embodiment the sheet is smooth which is defined as having a mean surface roughness less than 0.2 mm or, more preferably, less than 0.1 mm. Mean surface roughness is defined to be the average deviation of the surface of the sheet from an ideally flat plane that has equal area above the flat plane and equal area below the flat plane. In another embodiment, the sheet is rough or corrugated where the mean surface roughness is greater than 0.2 mm, 0.3 mm or 0.5 mm. One advantage of a rough sheet is that the sheet may be more compressible and when ejected from a canister will expand and separate from adjacent sheets. An embodiment provides compressible sheets where the compression ratio is defined as the height of a stack of uncompressed sheets divided by the height of a stack of the same number of sheets that are compressed under a force of 10 psi. Various embodiments provided compressible sheets having compression ratios of at least 1.1, at least 1.2, at least 1.5, at least 2.0, at least 2.5, or at least 3.0. In an embodiment, coupons with different degrees of surface roughness are stacked into a device. In an embodiment, coupons having a high surface roughness are interspersed with coupons having a low surface roughness so that there is one low surface roughness coupon between each high surface roughness coupon. In an embodiment, the coupons are curved.

The pyrophoric sheets described herein can be used as an infrared decoy device for confusing heat-seeking munitions. This decoy device comprises a container and coupons of the pyrophoric paper packed therein at a linear packing density of at least 100 coupons per inch, at least 200 coupons per inch, or at least 300 coupons per inch. In an embodiment, the sheets are compressed with force to increase the number of coupons per inch that can be packed into the container. An ejection device, such as a pyrotechnic explosive squib device, can be attached to the container. When the ejection device is activated, the coupons eject from the canister into the air and can heat to a maximum temperature of at least 200° C., at least 400° C., or at least 600° C. in 0.05 to 1.0 seconds. After ejection, the coupons may fragment into smaller pieces or remain as intact sheets.

EXAMPLES

Example 1

Pyrophoric Sheet

Iron oxalate nanoparticles are prepared from the rapid precipitation of the product of the reaction between an iron salt and oxalic acid from aqueous solution. A saturated solution of the iron salt, containing 20 g of ferrous sulphate heptahydrate and a minimum amount of water, was added to a rapidly stirred solution of an equimolar amount of oxalic acid (6.5 g) dissolved in a minimum amount of water. After five minutes of stiffing, the resulting yellow precipitate of ferrous oxalate, was collected by vacuum filtration and washed with a small amount of ethanol. The precipitate was air dried, crushed with a mortar and pestle, and suspended with dispersed glass microfibers that were obtained by probe ultrasonication of a Millipore glass fiber filter in ethanol. For 40 mL of ethanol, 300 mg of glass fibers and 2.4 g of ferrous oxalate were used. The solids were vacuum filtered from solution onto a sheet of coarse filter paper to form a paper-like sheet. This paper was then placed in an oven at 80° C. for one hour to remove the solvent. Once the material was dry, it was removed from the supporting filter paper. The composite paper, containing glass fiber and iron oxalate, was placed into a quartz tube inside a stainless pipe fitted with a gas inlet and output that fed through a bubbler. The pipe was placed into a furnace, having an internal temperature in the range of 300° C. to 500° C. A pure hydrogen atmosphere was passed through the pipe at a rate of 50 mL per minute. The sample remained under these conditions for one hour. After cooling to room temperature, the reduced pyrophoric sheet was transferred into a $N_2$ glovebox without exposure to air.

The resulting black pyrophoric sheet was inserted into an airtight fixture and removed from the glove box. On exposure to air, the pyrophoric paper rapidly heated.

Example 2

Preparation of High Temperature Pyrophoric Sheets

After preparation of iron oxalate in a manner similar to that described in Example 1, the iron oxalate was ball milled for 6 hours in a Union Process attritor mill, using 5 mm steel milling media to yield iron oxalate particles approximately 0.5 micron in diameter. The milled iron oxalate particles were centrifuged and washed in ethanol three times. The iron resulting oxalate particles were ground with a mortar and pestle and re-suspended in ethanol with glass fibers in a 4:1 ratio with the aid of probe sonication and then formed into a pyrophoric sheet in a manner similar to that described in Example 1 with reduction using an internal furnace temperature of 400° C. On exposure to air, the resulting black pyrophoric sheet rapidly heated.

Example 3

Graphite Coated Sheets

Ferrous oxalate was prepared from the reaction of ferrous sulphate and oxalic acid in aqueous solution and was isolated by vacuum filtration. 312.5 g of ferrous oxalate, 15.6 g of fine glass fibers (Lauscha B-06-F) and 15.6 g of 0.47 mil thick glass fibers were mixed with water using a commercial immersion blender for 30 seconds. To prevent settling of the suspension the reservoir was kept in constant motion with an overhead stirrer. 300 mL aliquots of the suspension were removed from the reservoir, mixed with 10 mL of a 6.5 g in 125 mL solution of Hormel 'Thick and Easy' starch and poured into the headbox of a 11"×17" deckel lined with Sefar mesh type 07-11/5. A vacuum was used to pull the water away from the solids to generate a wet web. The resulting 7" by 11" sheet was transferred to an oven on the filter material where it was dried at 80° C. for 30 min.

The resulting sheet was dried and removed from the filter and graphite powder (Sigma Aldrich 282863) was brushed across the surface using a foam brush to form a stiction-reducing coating on the sheet. A hydraulic press with a die was used to punch the sheet into circular coupons and the coupons were loaded into a quartz tube. The tube was placed inside a tube furnace and heated under a hydrogen atmosphere at 500° C. for three hours and transferred into an inert atmosphere glovebox for further handling. The sheets thus generated heat to 850° C. after 1 second on exposure to air. Sheets that have been treated with the stiction-reducing graphite powder coating have reduced surface binding.

Example 4

Borate Coated Sheet

Following the procedure in Example 3 up to just before brushing with graphite, the sheet was instead sprayed with or soaked in 20 mL of a saturated sodium borate solution and dried in an oven at 70° C. After drying, the sheet was then processed in the furnace under the same conditions as in Example 3. The resulting pyrophoric sheet had less stiction between layered sheets than when untreated, and stacks of coupons cut from such sheets more readily released to give individual coupons rather than agglomerated stacks.

Example 6

Transfer to a Second Container

Pyrophoric sheets were made in a manner similar to that described in Example 1 except that during wet web formation, a deckel was used instead of filter paper to form a paper-like sheet. The dewatered wet web was air dried and the resulting precursor sheet was punched into circular coupons. The coupons were stacked into the holder so that the faces of the stacked coupons were adjacent to each other. The holder was placed into a furnace at 400° C. and hydrogen gas was introduced into the container. After 1 hour, the holder was removed and transferred into a glove box. The end caps to the holder were removed and the holder was inserted into a device that links the holder to the final device container. A plunger was used to push the pyrophoric coupons from the holder to the device container. The container was sealed with a lid that has an O-ring. Clamps were placed on the container to keep the container sealed and air-tight.

Various modifications to the implementations described in this disclosure may be readily apparent to those skilled in the art, and the generic principles described herein may be applied to other implementations without departing from the spirit or scope of this disclosure. Thus, the disclosure is not intended to be limited to the implementations shown herein, but is to be accorded the widest scope consistent with the claims, the principles and the novel features disclosed herein. Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A pyrophoric sheet comprising oxidizable iron, non-combustible fibers, and a stiction-reducing coating, wherein the sheet has a water content of about 2% or less, by weight based on the total weight of the sheet, and wherein the oxidizable iron and the non-combustible fibers are dispersed within the sheet in an amount that is effective to heat the sheet to a temperature greater than 100° C. in less than 2 seconds upon exposure of the sheet to air.

2. The sheet according to claim 1, wherein the oxidizable iron is in the form of iron-containing particles having a BET surface area of at least about 1 $m^2/g$.

3. The sheet according to claim 1, wherein the stiction-reducing coating comprises a dry lubricant.

4. The sheet according to claim 1, wherein the stiction-reducing coating comprises a salt.

5. The sheet according to claim 1, wherein the iron content of the sheet is at least about 20%.

6. The sheet according to claim 1, wherein the thickness of the sheet is in the range of about 0.01 mm to about 0.5 mm.

7. The sheet according to claim 1, wherein the sheet has a compression ratio of at least 1.2.

8. The sheet according to claim 1, wherein the non-combustible fibers comprise at least one material selected from the group consisting of glass, ceramic, metal oxide, alumina, silica and metal.

9. The sheet according to claim 1, wherein at least about 30% of the non-combustible fibers, by weight based on total fiber weight, are glass fibers having an aspect ratio of at least about 20 and a diameter in the range of about 0.1 micron to about 5 microns.

10. An air tight container comprising a stack of sheets according to claim 1.

* * * * *